United States Patent [19]

Meyer et al.

[11] 4,060,929

[45] Dec. 6, 1977

[54] TOY DETECTIVE SET

[75] Inventors: Burton C. Meyer, Downers Grove; Robert K. Allen, Hinsdale, both of Ill.

[73] Assignee: Marvin Glass & Associates, Chicago, Ill.

[21] Appl. No.: 658,030

[22] Filed: Feb. 13, 1976

[51] Int. Cl.[2] ..... A63H 33/00; A63H 33/22

[52] U.S. Cl. ..... 46/11; 46/1 R; 46/22; 46/228; 40/131 R; 362/154; 240/2 P

[58] Field of Search ..... 240/2 AT, 2 R, 6.46, 240/6.4 R, 2 P, 6.4 B; 46/1 R, 11, 228; 40/131; 350/286; 220/4 E

[56] References Cited

U.S. PATENT DOCUMENTS

| | | | |
|---|---|---|---|
| 1,848,951 | 3/1932 | Haynes | 40/131 |
| 2,316,301 | 4/1943 | Ullman | 240/6.4 R |
| 2,358,203 | 9/1944 | Best | 240/2 P |
| 2,375,260 | 5/1945 | Suydan | 240/2 AT |

*Primary Examiner*—F. Barry Shay
*Attorney, Agent, or Firm*—Mason, Kolehmainen, Rathburn & Wyss

[57] ABSTRACT

A toy detective set for the amusement of children includes a casing for housing various detective play items. The casing is formed from two identical and mating casing halves which can be separated and expose the play items. The set also includes a flashlight which has a top handle. The flashlight has a locking system on the bottom thereof for engaging the casing halves to lock them together in closed position. The flashlight handle then can be used as the carrying handle for the combined interlocked flashlight and casing. Mounting boards are provided within the casing, having hooks or the like for releasably mounting such detective items as a rotatable reflective mirror which can be used in combination with the flashlight for producing a flasher effect, a viewing scope which can be mounted on the flashlight for viewing objects illuminated by the flashlight, a magnifying glass and fingerprint analyzer which also can be mounted on the flashlight for illuminating fingerprints and comparing them with fingerprints on a card, fingerprint powder and ink for producing fingerprints on a fingerprint card or other substrate, clay for taking impressions of objects, a roll of transparent adhesive tape for picking up fingerprints or other evidence of a crime, a handwritting analyzer which is used in combination with the flashlight, a face identifying device for reconstructing facial characteristics of an imaginative criminal and a supply of cards including police record cards and case evidence cards. Shelves are provided in the casing halves for holding papers, the supply of clay, pencil and fingerprint brush, and separate compartments are provided in the casing for containing the fingerprint powder and ink and the viewing scope.

17 Claims, 12 Drawing Figures

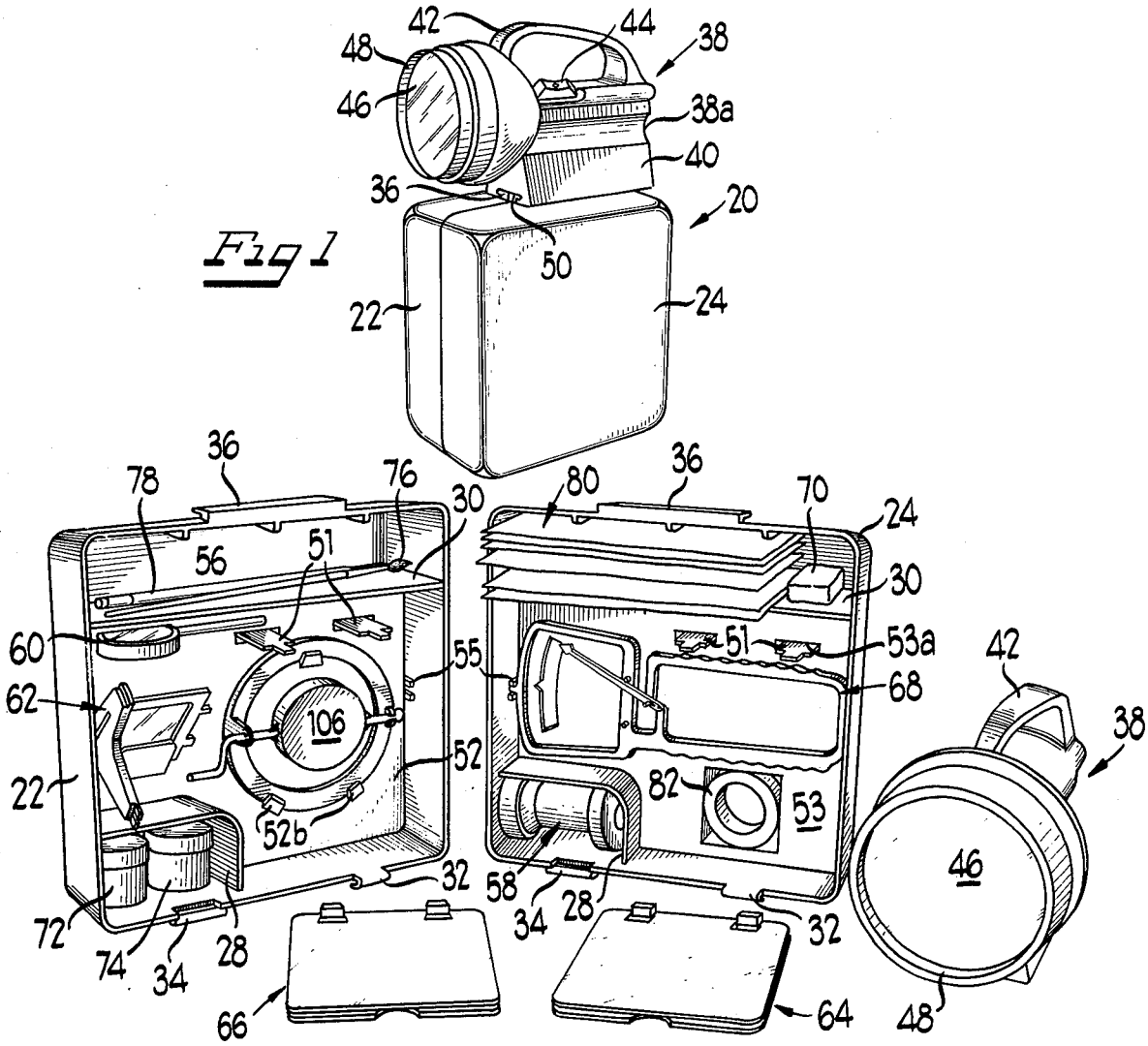
Fig 1
Fig 2
Fig 3
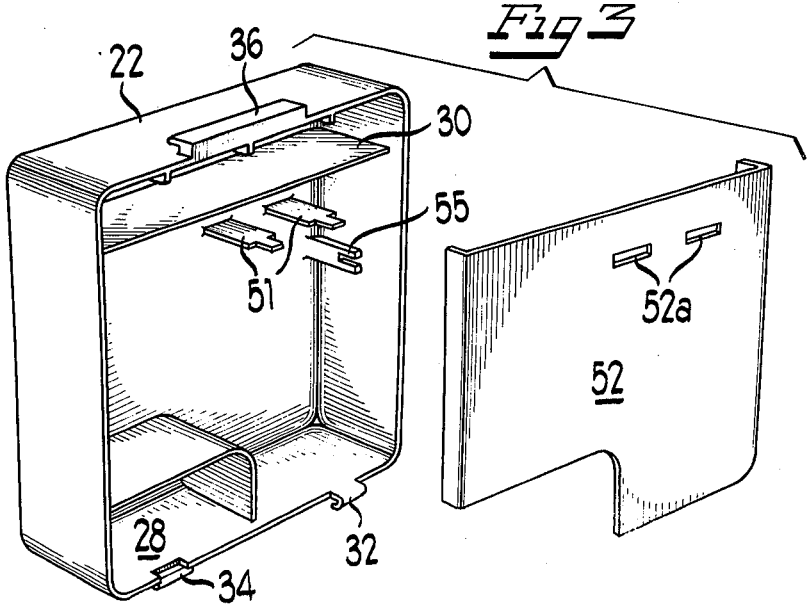

Fig 8
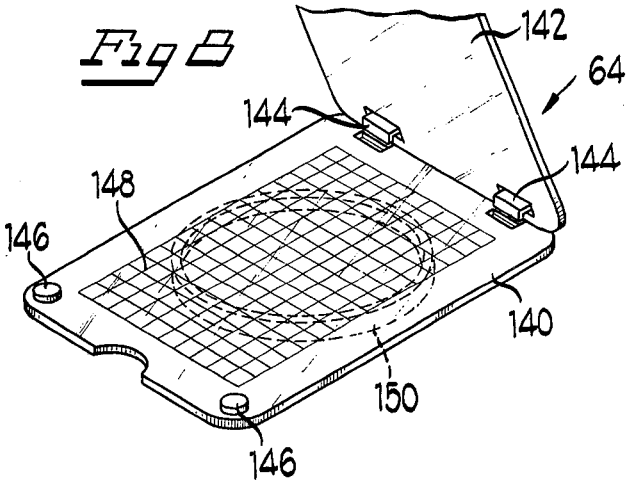
Fig 10
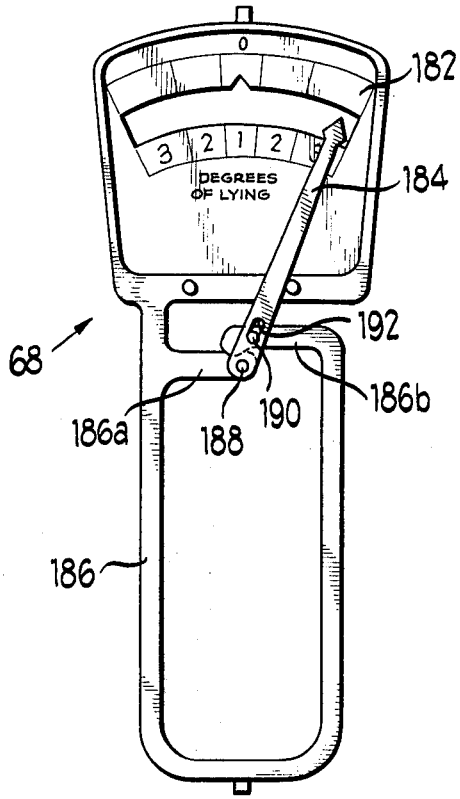
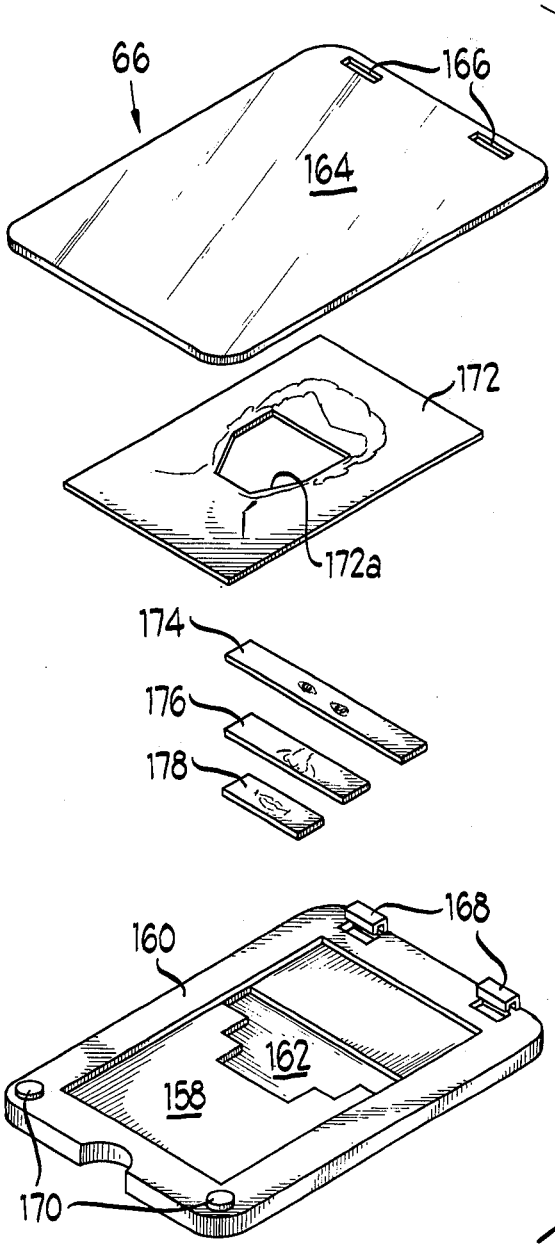
Fig 9
Fig 11
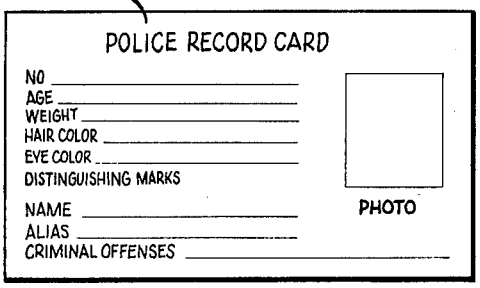
Fig 12
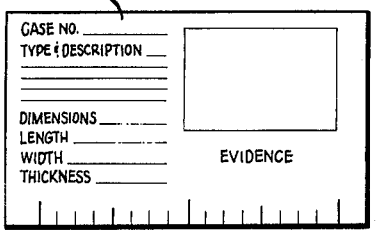

TOY DETECTIVE SET

BACKGROUND OF THE INVENTION

1. Field of the Invention

This invention relates to children's amusement devices and more particularly relates to a detective set including various play items designed for playing a detective game.

2. Brief Description of the Prior Art

Children's play sets, such as doctor or nurse sets, and the like have, in the past, been well received by the public. Such sets, due to the variety of their contents, can keep children amused for extended periods of time and are very popular with children. Detective games also are popular with children but, so far as is known, a comprehensive set for playing detective games has not yet been provided.

SUMMARY OF THE INVENTION

The present invention provides a new and useful detective set for use by children. The set includes a carrying case composed of two mateable case portions, a flashlight and an interlock between the flashlight and the case which locks the mated case portions together and also provides a handle for carrying the interlocked unit.

The carrying case contains a number of items useful in amusing children in detective games, many in association with the flashlight. For example, a flasher device for emitting alternate colored and white light flashes can be provided in the form of a double mirror having one surface for reflecting white light from the flashlight and the other tinted for reflecting light as a colored beam. The mirrors are mounted for rotation on a frame which is in turn removably mountable on the flashlight in a position such that the mirror surfaces receive a beam of light from the flashlight as the mirror is rotated.

Also for use in combination with the flashlight, a handwriting analyzer can be provided which includes a translucent base supportable on the flashlight for receiving light therethrough. The base has a grid work pattern and handwriting samples can be placed thereon and illuminated for comparing the handwriting with the grid background.

Another object for inclusion in the case is a fingerprint examining device having a base plate for mounting on the flashlight. A transparent plate upstands from the base plate receiving light from the flashlight through one edge of the transparent plate for illuminating the transparent plate. A finger or other digit is pressed against the rear surface of the transparent plate for viewing by a magnifying glass mounted on the base plate in a position generally parallel to the front surface of the transparent plate. Means also is provided for mounting a fingerprint card on the device in a position for viewing through the magnifying glass so that the fingerprint card and the fingerprint on the platen can be viewed at the same time and compared with each other.

The detective set also includes a face identifying kit which is used by arranging facial outlines indicia and eye, nose and mouth indicia as they would normally appear on a face. Accordingly, face outline cards are placed over properly aligned set of eye, nose and mouth strips and the strips and cards can be interchanged with other strips and cards showing different facial features until the face of a play suspect is recreated.

A toy lie detector also is included in the detective set. The lie detector includes a dial having an indicator and a squeezable handle for moving the indicator across the dial surface. In one such lie detector, a central position is provided and the play objective is to maintain the indicator in the central dial position without waivering to either side, indicating nervousness as a result of telling a lie.

Still another play item or object which can be included in the case is a viewing scope which is removably mountable on the flashlight in a position for viewing objects illuminated by the flashlight.

While this invention is susceptible of embodiment in many different forms, there is shown in the drawings and will herein be described in detail a specific embodiment and modification thereof, with the understanding that the present disclosure is to be considered as an exemplification of the principles of the invention and is not intended to limit the invention to the embodiment illustrated.

BRIEF DESCRIPTION OF THE DRAWINGS

FIG. 1 is a perspective view of an embodiment of a toy detective set of this invention in the form of a casing and flashlight combination;

FIG. 2 is an enlarged perspective view of the embodiment of FIG. 1 with parts disassembled and/or removed to show contents of the casing;

FIG. 3 is a perspective view of one position of the casing as shown in FIG. 2 with contents removed, but showing a divider or mounting board;

FIG. 8 is a fragmentary enlarged perspective view of a handwriting analyzing kit contained in the casing of FIG. 1;

FIG. 9 is an exploded enlarged perspective view of a face identification kit contained in the casing of FIG. 1;

FIG. 10 is a plan view of a lie detector device contained in the casing of FIG. 1;

FIG. 11 illustrates a police record card useful in playing with the detective set; and FIG. 12 illustrates a case evidence card useful in playing with the detective set.

DESCRIPTION OF THE PREFERRED EMBODIMENT

Figure 4:
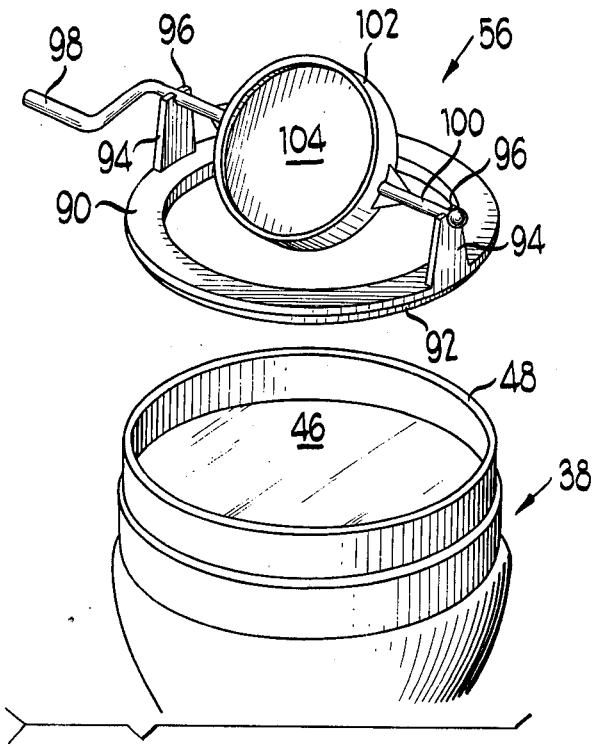
FIG. 4 is an enlarged fragmentary perspective view of the flashlight and a flasher device contained in the casing of FIGS. 1 and 2.

Referring first to FIGS. 1 through 3, the detective set of the present invention includes a casing, indicated generally by reference numeral 20, and composed of two identical mating casing halves 22 and 24, each casing half having a lower compartment 28 and an upper shelf 30. Shelf 30 is spaced below and generally parallel to the upper wall of the casing half.

A hook element 32 extends at the edge of the lower wall of each casing half to be received in a hook receiver 34 in the other casing half when the halves are mated. Each casing half also has an inverted L-shaped flange element 36 extending upwardly from the top wall at the mating edge thereof with the foot of the L-shape projecting away from the mating edge so that when the two casing halves are mated, the flanges abut along their leg portions and, in combination, form a T-shaped lock element (see FIG. 1).

The detective set also includes a flashlight 38 (FIGS. 1, 2, 3, 5 and 7) having a battery case 40, a top handle 42, an appropriate on-off switch 44 (FIG. 1), and a lens 46 (FIGS. 1, 2 and 4). An annular flange 48 projects outwardly at the periphery of lens 46. A T-shaped groove 50 (FIG. 1) is provided on the bottom wall of flashlight 38 as a receiver for slideably receiving the combined flanges 36 to lock the flanges and casing halves 22 and 24 together in mated condition.

Each casing half is provided with a pair of support projections 51 (FIGS. 2 and 3) and a mounting board 52 or 53 having a pair of slots 52*a* or 53*a* which are received on the support projections 51 to removably support the mounting boards within the casing half. A releasable snap or friction lock for the mounting boards can be provided to retain the mounting boards in position, in the form of pins (not shown) which can be snap or snug received in receivers, as shown at 55 (FIGS. 2 and 3).

As can be seen in FIG. 2, a number of items or objects are contained and/or mounted within casing 20. Suitable hooks, as at 52*b*, are provided on the mounting boards 52 and 53 for mounting some of the items. Among the items are a flasher unit 56 (see also FIG. 4) for use in combination with the flashlight 38, a viewing scope 58 (see FIG. 5) for viewing objects illuminated by the flashlight, a fingerprint examining system including a magnifying glass 60 (see FIGS. 6 and 7), and a card and print mount 62, a handwriting analyzing kit 64 (see FIG. 8), a suspect identification kit 66 (see FIG. 9), a lie detector 68 (see FIG. 10), a mass of molding clay 70, a container of fingerprint powder 72, a container of fingerprint ink 74, a fingerprint brush 76, a pencil 78, and papers, forms and cards, such as indicated at 80 on shelf 30 of casing half 24, and a roll of transparent adhesive tape 82.

Turning now more particularly to FIG. 4, flasher 56 has a frame in the form of a ring 90 having a downwardly projecting annular flange 92 and upwardly projecting opposing support posts 94 each having a snap receiver 96. The snap receivers 96 receive a crank 98 and a shaft 100 which are coaxial and secured to opposite sides of a mirror frame 102 which holds a double mirror, including (facing outwardly on opposite sides) an untinted reflective mirror 104 and a tinted reflective mirror 106 (FIG. 2), e.g., tinted red.

To operate the flasher, the flasher is assembled with flashlight 38 telescoping the flange 92, by snug fit, with the flashlight flange 48. The flashlight is turned on and crank 98 is turned to alternately present mirrors 104 and 106 in light reflecting position with respect to the flashlight so that a white and red alternate flashing effect is obtained. During use of the flasher, the flashlight 38 normally will be positioned upright resting on its generally flat butt end 38*a* (see FIGS. 1 and 5).

Figure 5:
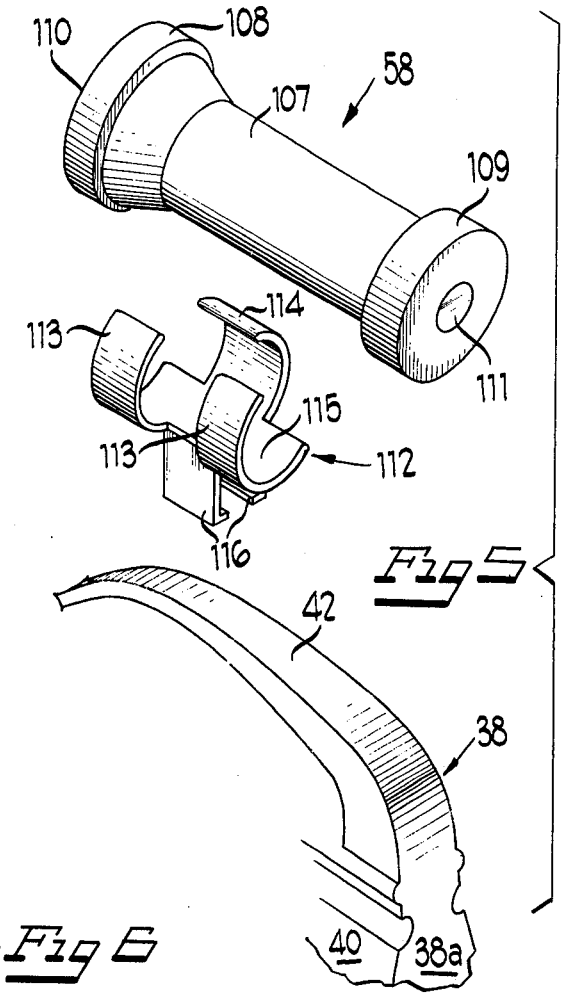
FIG. 5 is an enlarged fragmentary view of the flashlight and a viewing scope contained in the casing of FIGS. 1 and 2.

Turning now to FIG. 5, the viewing scope 58 includes a tubular body portion 107 terminating at and merging with an enlarged lens holder portion 108 at one end and an enlarged eyepiece portion 109 at the other end. Lens holder portion 108 has a glass or clear plastic lens as at 110 and eyepiece portion 109 has a glass or clear plastic lens 111. A mounting clip 112 has opposing resilient arcuate fingers 113 and 114 forming a receiver for snap receiving body portion 107. The base 115 of clip 112 has depending opposing inwardly facing "L" flanges or legs 116 forming a receiver therebetween for straddling the handle. Handle 42 of flashlight 38 tapers outwardly in its dimensions as it extends rearwardly so that the forward portion of handle 42 can be freely received between flanges 116 and as clip 112 is moved rearwardly, flanges 116 provide a force or snug fit on handle 42 to secure clip 112 and scope 58 on handle 42. Once the scope 58 is assembled on the flashlight 38, the flashlight is turned on and at least a portion of the area illuminated by the flashlight can be viewed through the scope.

Figure 6:
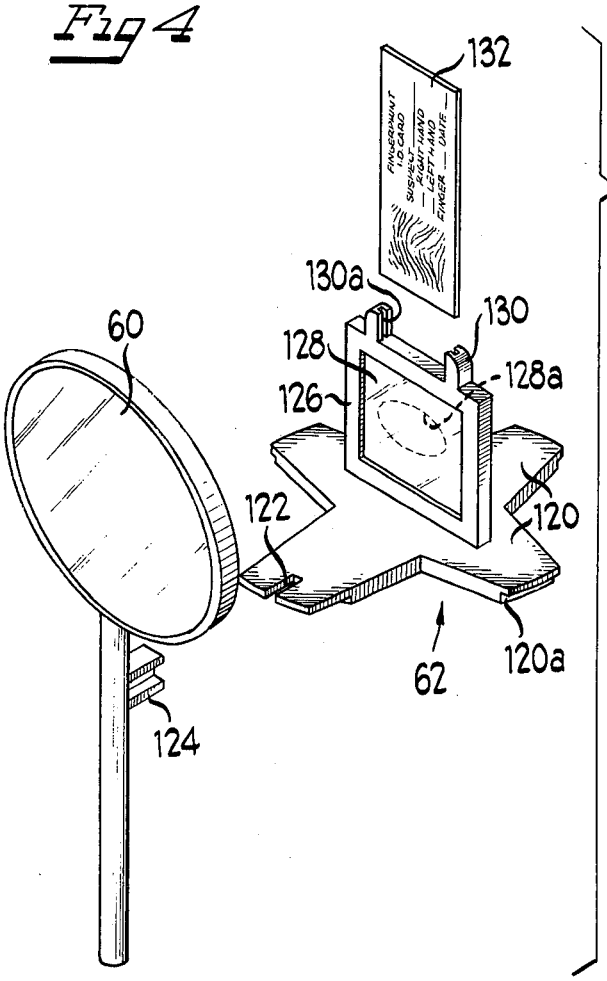
FIG. 6 is an exploded enlarged perspective view of a fingerprint identification device which is contained in the casing of FIGS. 1 and 2.
Figure 7:
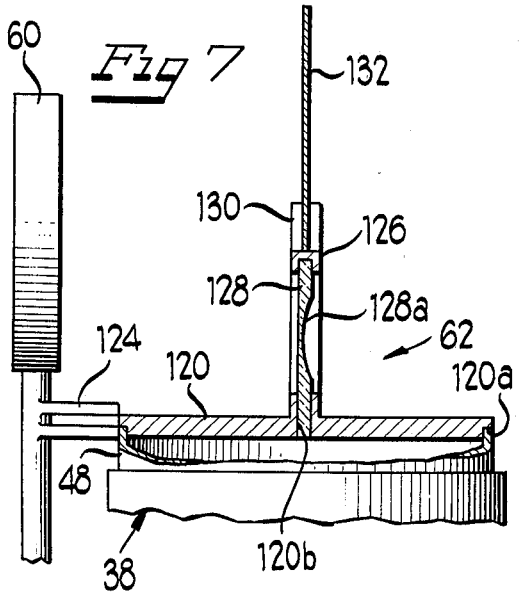
FIG. 7 is a fragmentary sectional view through the fingerprint identification device of FIG. 6, assembled for use.

Another item in the detective set is a fingerprint examining system (FIGS. 6 and 7). This system includes the magnifying glass 60 and the card and print mount 62. Card and print mount 62 includes a base member 120 having a slot 122 for removably slidably receiving the center post of an I-stub 124 on the handle of magnifying glass 60. A frame 126 upstands from base member 120 and holds a transparent platen 128, e.g., of glass or plastic, having a depression 128*a* in the rear surface thereof into which a thumb or other digit can be pressed for viewing of its print characteristics through the magnifying glass 60.

Base member 120 has peripheral grooves 120*a* for receiving flange 48 (FIG. 7) of flashlight 38. Platen 128 projects at its lower edge through a slot 120*b* in base member 120 to receive light from flashlight 38 and thereby illuminate platen 128 and any print impression of the surface of depression 128*a*.

A pair of upstanding ears 130 have facing grooves 130*a* for receiving edges of a fingerprint card 132 and supporting the card 132 in a position to be simultaneously viewed along with an impression on the surface of depression 128*a* for the purpose of comparing prints. Fingerprint card 132 may be opaque with the print on the front surface so that the compared prints wil be reversed relative to each other, or card 132 may be transparent with the print on the back surface for direct comparison of the prints.

With particular reference to FIG. 8, the handwriting analyzing kit 64 includes a transparent or translucent base plate 140 and a transparent cover 142 pivotally mounted thereon in tabloid form by hinges 144. Stops 146 are provided on base plate 140 so that cover 142 does not come into actual facial contact with plate 140 when cover 142 is moved to closed position. Plate 140 has a grid surface at 148 and is provided with a depending circular flange 150 for telescopic engagement with rim 48 (see FIG. 4) of flashlight 38.

In using the handwriting analyzing kit 64, a sample of handwriting is placed on the grid surface 148 of base plate 140 and cover 142 is closed. The device then is mounted on the flashlight 38 which is turned on so that the grid surface 148 is illuminated as a background behind the handwriting sample, permitting analysis of vertical and horizontal handwriting strokes and differences in variation from vertical and lateral as against the grid. Two handwriting samples can be placed in the device side-by-side for comparison purposes.

Turning now to FIG. 9, the suspect identification kit 66 includes a base plate 158 having a generally peripheral raised ledge 160. A transparent cover 164 is hingedly connected to the face plate 158 by slots 166 received on hooks 168 upstanding from ledge 160. Stops 170 are provided to prevent complete facial contact of transparent cover plate 164 with ledge 160.

As accessory equipment, a plurality of "face" cards 172, "eye" strips 174, "nose" strips 176, and "mouth" strips 178 are provided, each card or strip having differing configurations of the facial characteristic shown. In use, the card and strips having a characteristic most similar to the play criminal or suspect are selected. The eye, nose and mouth strips 174, 176 and 178 are removeably positioned in an appropriately sized recess 162 in base plate 158 and the face card 172 is placed thereover. Cover 164 then is moved to closed position. The face card 172 has a central opening 172*a* through which the eye, nose and mouth strips can be viewed giving a composite face image for the viewer.

The structure of lie detector 68 is best shown in FIG. 10. Detector 68 includes a dial 182, an indicator or pointer 184 and a resilient squeeze handle 186 secured to the dial. The handle 186 extends downwardly from dial 182 and doubles back in the general form of a rectangle with one end of the rectangle formed by overlapping arms 186*a* and 186*b* which move longitudinally relative to each other during squeezing and release of the resilient handle 186.

A pivot pin 188 is secured to arm 186*a* and pivotally mounts the pointer 184. Another pin 190 is mounted on arm 186*b* and is received in a lost motion slot 192 on pointer 184.

The lie detector device can be used in many types of play. In the device shown, a central position is shown on dial 182 labeled with a zero and the objective is to squeeze the handle 186 to bring the pointer 184 to the zero position on dial 182 and hold the pointer in zero position while the play suspect is being questioned. A marked variance in position of the pointer or needle from the zero position indicates nervousness, a symptom of lying.

Turning now to FIGS. 11 and 12, the detective set also is provided with a supply of police record cards 196 and case evidence cards 198. The cards can be filled out by the child with available or invented information while playing with the set.

It will be evident from the foregoing description that the detective set described herein is useful in the entertainment of children.

We claim:

1. An amusement set, comprising: a casing having two mateable casing portions each having a top wall and a bottom wall, said casing portions mating along a peripheral seam line, hinge means for hingedly connecting said casing portions along the seam line, lockable members at each of the casing portion top walls adjacent the top wall seam line, a flashlight having a grippable handle and including lock means between the flashlight and casing for releasably locking said lockable members of said casing and releasably joining the flashlight to the casing top wall whereby the flashlight handle serves as a carrying handle for the casing and the flashlight with the casing locked.

2. The device of claim 1 wherein the two casing portions are identical casing halves and said seam line is generally vertical, said hinge means comprising complementary hook means on the casing halves at the bottom wall mating edges thereof.

3. The device of claim 1 wherein said lockable members comprise a pair of upstanding inverted L-shaped flanges, one on each casing half top wall and extending along the top wall seam line to define a T-shaped assembly when the casing halves are mated, and wherein said lock means includes a T-shaped groove for receiving said flanges and locking the casing halves together.

4. The device of claim 1 including detective set play objects positionable within said casing.

5. The device of claim 4 wherein said flashlight has a lens with a rim projecting outwardly beyond the lens in the form of a flange.

6. The device of claim 5 wherein said play objects include a fingerprint examining device having a base member mountable on said flashlight flange and a substantially transparent panel on said base member for receiving light from the flashlight to thereby illuminate the panel so as to highlight any fingerprints thereon.

7. The device of claim 6 including means on said panel for mounting a fingerprint card thereon for comparison of fingerprint characteristics on the panel with fingerprint characteristics indicia on the card.

8. The device of claim 5 in which one of said play objects is a handwriting analyzer, said handwriting analyzer comprising a translucent base plate having a flange depending from the bottom surface thereof for engagement with the flashlight flange for directing light from the flashlight through said base plate, said base plate including a grid thereon whereby a sample of handwriting can be placed on the base plate, the flashlight turned on and illumination from the flashlight through the base plate grid and the handwriting sample permits the comparison of the handwriting sample with the grid and/or another sample.

9. The device of claim 8 including a transparent cover plate hingedly connected to said base plate for pivotal movement into facing position relative to the base plate to sandwich the handwriting sample therebetween.

10. The device of claim 5 wherein said play objects include a fingerprint examining device having a base member, an upstanding transparent panel on said base member, means for mounting a fingerprint card adjacent said panel, a magnifying glass, means for removably mounting said magnifying glass on said base member in an upright position spaced from and facing the front surface of the panel but generally parallel to said panel for viewing both said panel and said card, said panel having an edge exposed to light through said base member and said base member having means for mounting it on the flashlight flange to thereby illuminate the panel by entry of the light through the exposed edge.

11. The device of claim 10 wherein said panel includes a depression in one surface thereof for receiving a human digit for comparison of fingerprint characteristics with fingerprint characteristic indicia on the card.

12. The device of claim 4 wherein said play objects include a face identifying kit comprising a base plate, a plurality of feature strips having indicia of various eye, nose and mouth configurations, means for removably mounting said strips on said base plate with the eye, nose and mouth strips correctly positioned as on a human face, a plurality of face cards each having a different facial feature for hair, ears and the like and each having a central opening of sufficient size to view the eye, nose and mouth strip indicia therethrough, means on said base plate for locating a face card placed over the eye, nose and mouth strips so that the eye, nose and mouth indicia are viewably in their proper positions through the face card opening, and transparent cover means for covering said face plate with the strips and card in position for viewing.

13. The device of claim 4 wherein said play objects include a toy lie detector which comprises a dial having a central position and two end positions, handle means secured to said dial, said handle means being of a resilient material with opposing first and second portions movable with respect to each other upon gripping and squeezing the handle, an elongate indicator for said dial, means pivotally mounting said indicator on the first of said handle portions forming a first pivot for said indicator, lost motion means connecting said indicator to the second handle portion and forming a second pivot for the indicator, said second pivot being spaced along the indicator relative to said first so that when the handle portions are moved toward each other the indicator sweeps said dial.

14. The device of claim 13 in which said lost motion means comprises a pin on said second handle portion and a slot in said indicator for receiving the pin.

15. The device of claim 1 wherein the handle of said flashlight is tapered, an elongate viewing scope, and clip means for releasably receiving said scope and including opposing depending legs forming a receiver therebetween for straddling the handle, said receiver being of proper size for freely receiving said handle at a narrow portion thereof and for force fit against said handle when slidingly moved to a wider portion of the handle.

16. The device of claim 6 including a magnifying glass removably mountable on said base member spaced from and facing said panel.

17. A detective amusement set for use particularly by children, comprising: a flashlight having a lens with a rim projecting outwardly beyond the lens in the form of a flange, and a play object for use with the flashlight comprising a fingerprint examining device having a base member, an upstanding transparent panel on said base member, means for mounting a fingerprint card adjacent said panel, a magnifying glass, means for removably mounting said magnifying glass on said base member in an upright position spaced from and facing the front surface of the panel but generally parallel to said panel for viewing both said panel and said card, said panel having an edge exposed to light through said base member and said base member having means for mounting it on the flashlight flange to thereby illuminate the panel by entry of the light through the exposed edge, and said panel including a depression in the rear surface thereof for receiving a human digit for comparison of fingerprint characteristics with fingerprint characteristic indicia on the card.

* * * * *